US009291353B2

(12) United States Patent
Saporetti et al.

(10) Patent No.: US 9,291,353 B2
(45) Date of Patent: Mar. 22, 2016

(54) HOUSEHOLD OVEN

(75) Inventors: Marco Saporetti, Porcia (IT); Cris Tridello, Porcia (IT)

(73) Assignee: ELECTROLUX HOME PRODUCTS CORPORATION N.V., Brussels (BE)

( * ) Notice: Subject to any disclaimer, the term of this patent is extended or adjusted under 35 U.S.C. 154(b) by 688 days.

(21) Appl. No.: 13/576,486

(22) PCT Filed: Feb. 4, 2011

(86) PCT No.: PCT/EP2011/051621
§ 371 (c)(1),
(2), (4) Date: Aug. 1, 2012

(87) PCT Pub. No.: WO2011/098399
PCT Pub. Date: Aug. 18, 2011

(65) Prior Publication Data

US 2012/0298095 A1 Nov. 29, 2012

(30) Foreign Application Priority Data

Feb. 10, 2010 (EP) ..... 10153137

(51) Int. Cl.
*F24C 15/04* (2006.01)
*F24C 15/02* (2006.01)

(52) U.S. Cl.
CPC ..... *F24C 15/024* (2013.01); *F24C 15/02* (2013.01)

(58) Field of Classification Search
CPC ..... F24C 15/02; F24C 15/024
USPC ..... 126/192, 197
See application file for complete search history.

(56) References Cited

U.S. PATENT DOCUMENTS

| | | | | |
|---|---|---|---|---|
| 4,043,091 | A * | 8/1977 | Katona | 52/786.1 |
| 4,892,342 | A * | 1/1990 | Newman et al. | 292/347 |
| 7,122,766 | B1 * | 10/2006 | Main | 219/414 |

FOREIGN PATENT DOCUMENTS

| | | | |
|---|---|---|---|
| DE | 2829720 | | 1/1980 |
| DE | 3935803 | A1 * | 5/1991 |
| DE | 10349313 | | 5/2005 |
| DE | 102005042805 | A1 * | 3/2007 |
| DE | 202007012603 | | 1/2009 |
| EP | 1767864 | | 3/2007 |
| EP | 2068087 | | 6/2009 |

OTHER PUBLICATIONS

International Search Report for PCT/EP2011/051621, dated May 19, 2011, 3 pages.

* cited by examiner

*Primary Examiner* — Kenneth Rinehart
*Assistant Examiner* — Gajanan M Prabhu
(74) *Attorney, Agent, or Firm* — Pearne & Gordon LLP

(57) ABSTRACT

A household oven (1) comprising an outer boxlike casing (2) which is internally provided with a inner cooking cavity (2*a*) for housing the food products to be cooked and that communicates with the outside via an access opening realized on the front face (2*b*) of the casing, a front door (3) which is hinged to the front face (2*b*) of the casing to rotate to and from a closing position in which the front door (3) rests against the front face (2*b*) of the casing to close the access opening realized therein, and an internal heating assembly (4) which is structured for heating and/or maintaining the inside of the inner cooking cavity (2*a*) at a given cooking temperature; the household oven (1) also comprising a push-push handle (11) which is completely recessed into a seat (Ha) realized in the outer face (3*a*) of the front door (3), and is structured for alternatively assuming a stable withdrawn position in which the push-push handle (11) remains motionless completely housed into the front door (3) and forms part of the outer face (3*a*) of the front door (3), and a stable extracted position in which the push-push handle (11) motionless partly protrudes out of the outer face (3*a*) of the front door (3) so as to be seizable by the user.

16 Claims, 5 Drawing Sheets

HOUSEHOLD OVEN

The present invention relates to a household oven.

More specifically, the present invention relates to an electric built-in household oven, to which the following description refers purely by way of example.

As is known, today's electric built-in household ovens generally comprise: a rigid outer boxlike casing which is structured for being stably fitted into a piece of kitchen furniture, and is internally provided with a substantially parallelepiped-shaped inner cooking cavity for housing the food products to be cooked, and which communicates with the outside through a substantially rectangular access opening realized in the center of the front face of the casing; a substantially rectangular front door which is hinged to the front face of the casing to rotate to and from a closing position in which the door rests completely against the front face of the casing to close the access opening realized therein, and substantially airtight seal the cooking cavity; and an internal electric heating assembly which is structured for heating and maintaining the inside of the inner cooking cavity at a given temperature selectable by the user.

Additionally, built-in household ovens of the above type are provided with a control panel which is usually located on the front face of the casing, immediately above the access opening, and is structured for allowing the user to manually select the cooking temperature and optionally further working parameters of the internal electric heating assembly; and with a large horizontal handle which is attached onto the front face of the door, close to the upper horizontal edge of the latter, for allowing the manual opening and closing of the front door.

As regards the front door, it usually has a double-glazed type structure to provide the necessary thermal insulation, and is hinged onto the front face of the casing next to its lower horizontal edge, so as to be able to rotate about a substantially horizontal reference axis between a raised closing position in which the perimeter of the door abuts completely against the front face of the casing to close the access opening and seal the cooking cavity, and a lowered opening position in which the door extends substantially horizontally so as to free the access opening and cantileverly jut out from the front face of the casing substantially parallel to the ground.

The front door of today's household ovens is further provided with a central window usually made in safety annealed glass, through which the user can watch the food products during the cooking process.

Unfortunately according to several final users, the presence of a large horizontal handle which permanently protrudes from the front face of the door, creates lots of problems to a person standing or quickly moving inside the kitchen very close to the piece of furniture housing the oven.

Aim of the present invention is therefore to provide a built-in household oven structured to eliminate this drawback.

In compliance with the above aim, according to the present invention there is provided a household oven as specified in claim 1 and preferably, though not necessarily, in any one of the dependent claims.

Thus, the present invention relates to a household oven comprising an outer boxlike casing internally provided with a inner cooking cavity for housing the food products to be cooked and communicating with the outside via an access opening realized on the front face of the casing, a front door hinged to the front face of the casing to rotate to and from a closing position in which the front door rests against the front face of the casing to close the access opening, and an internal heating assembly structured for heating and/or maintaining the inside of the inner cooking cavity at a given cooking temperature; the household oven also comprising a push-push handle positioned in a seat realized in the outer face of the front door and structured for alternatively assuming a stable withdrawn position in which it remains motionless completely housed into the front door and forms part of the outer face of the front door, and a stable extracted position in which it motionless partly protrudes out of the outer face of the front door so as to be seizable by the user.

For the purposes of the present invention, with "push-push" handle it is intended a handle having two operative positions, such as open and close, and designed so as to need a pushing action by a user both for passing from the first to the second position and for passing from the second to the first position.

Advantageously, the push-push handle is completely recessed into the above-mentioned seat in the outer face of the front door.

In a preferred embodiment, the push-push handle comprises a substantially basin-shaped vessel recessed into the seat on the front door so that the rim of the vessel is substantially coplanar to the outer face of the front door. Moreover, the push-pull handle preferably comprises a substantially flat lid located within the vessel substantially coplanar to the rim of the vessel, and pivotally jointed to the basin-shaped vessel so as to rotate about a first reference axis between a closed and an opened position. In the closed position, the lid is substantially coplanar to the vessel rim and closes the basin-shaped vessel, and in the opened position the lid is rotated/tilted of an angle greater than 10° with respect to the reference laying plane of the rim, so as to partly protrude out of the basin-shaped vessel.

Preferably, the said first reference axis is located behind the flat lid, between the reference laying plane of the rim and the bottom of the vessel.

In a preferred embodiment, the push-push handle also comprises elastic means housed into the basin-shaped vessel behind the flat lid and structured for elastically pushing and keeping the flat lid in the opened position. Moreover, still in a preferred embodiment, the push-push handle comprises automatic locking means housed into the basin-shaped vessel behind the flat lid, and structured for selectively blocking the flat lid in the closed position.

The push-push handle may also comprise rotation damping means housed into the basin-shaped vessel behind the flat lid, and structured for slowing down the rotating speed of the flat lid about the first reference axis.

The rotation damping means may be structured to progressively thwart the elastic force of the elastic assembly acting on the flat lid for pushing and keeping said lid into the opened position, so as to progressively slow down the rotation speed of the flat lid as the lid moves towards the opened position.

Advantageously, the flat lid substantially copies the perimeter of the rim of the basin-shaped vessel.

The basin-shaped vessel may also be provided with a snap-on locking mechanism for irremovably anchoring the vessel into the seat on the outer face of the front door.

The basin-shaped vessel may be irremovably anchored to the front door via at least one longitudinal strip of glue which is positioned on a lateral sidewall of the vessel, immediately behind the rim of the vessel.

The surface of the lateral sidewall of the vessel may be plasma polished beneath said strip of glue.

Both the basin-shaped vessel and the flat lid may be substantially rectangular in shape.

Preferably, the front door has a double-glazed type structure.

The front door may be hinged onto the front face of the casing next to one of its lateral edge, so as to be able to rotate about a substantially horizontal or vertical second reference axis, between a closing position in which the perimeter of the front door completely abuts against the surface of the front face to close the access opening and seal the inner cooking cavity; and an opening position in which the front door extends substantially horizontally or vertically immediately below or beside the access opening on the front face, so as to completely free the access opening on said front face.

Advantageously, the internal heating assembly comprises a resistor which is located inside the inner cooking cavity, and an electronic central control unit which powers the resistor so as to heat and/or maintain the inside of the inner cooking cavity at a cooking temperature selectable by the user.

A non-limiting embodiment of the present invention will now be described by way of example with reference to the accompanying drawings, in which:

FIG. 6 shows in enlarged scale a particular of FIG. 4; whereas

Figure 1:
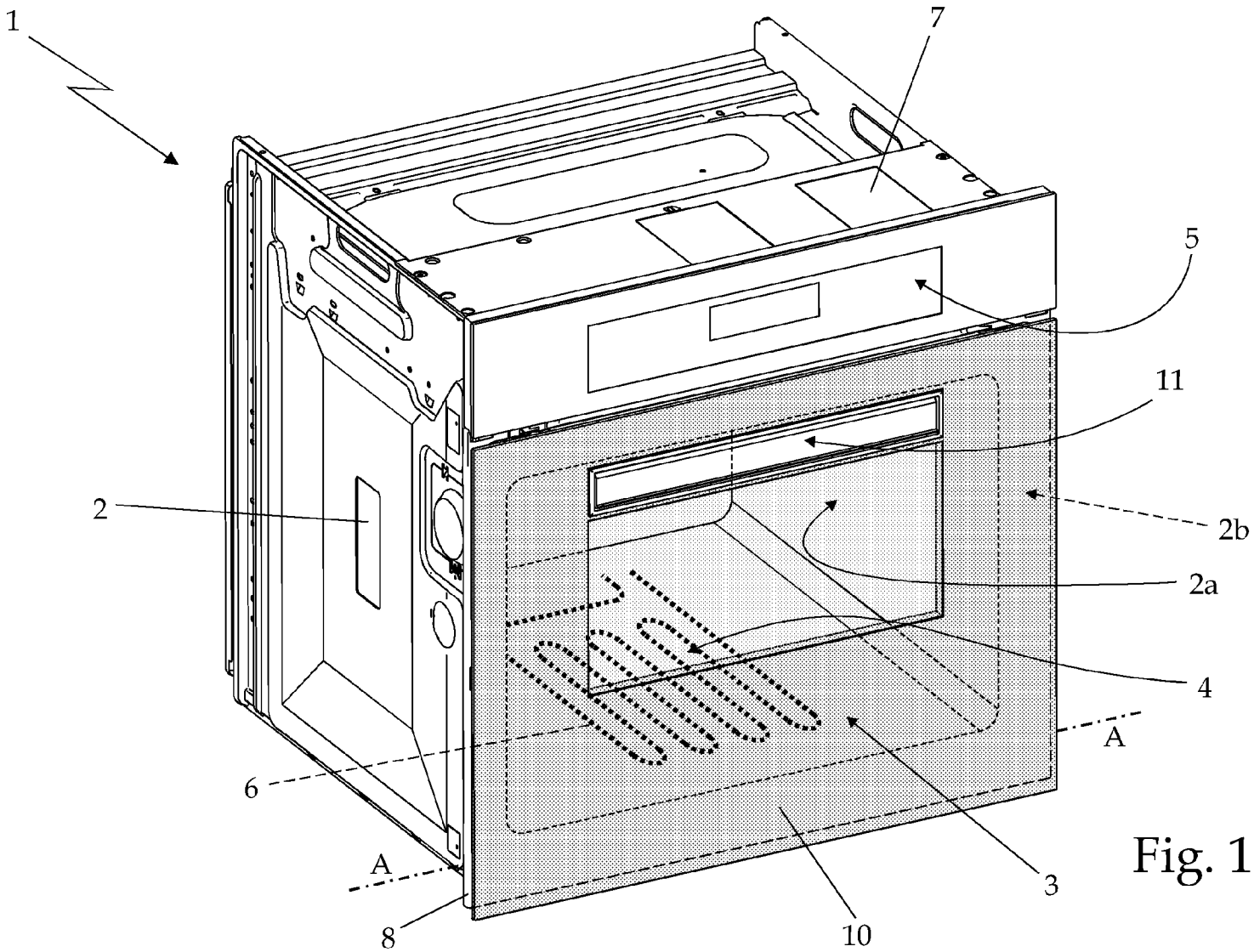
FIG. 1 is a perspective view, with parts removed for clarity, of an electric built-in household oven realized in accordance with the teachings of the present invention.
Figure 2:
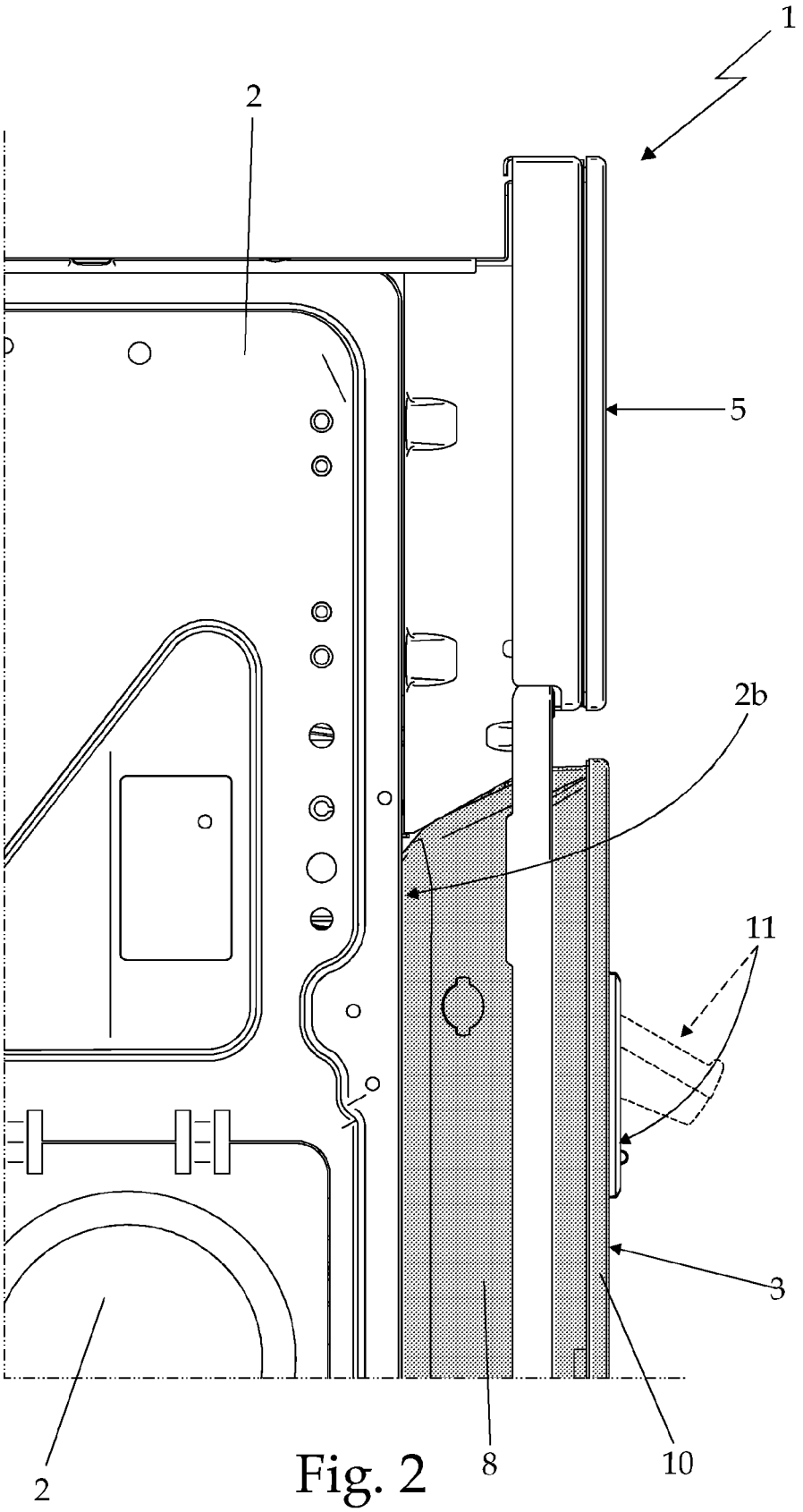
FIG. 2 is an enlarged lateral view of the upper portion of the FIG. 1 household oven.

With reference to FIGS. 1 and 2, number 1 indicates as a whole a household oven which comprises: a rigid outer boxlike casing 2 which is preferably, though not necessarily, structured for being stably fitted into a generic piece of kitchen furniture (not shown), and is internally provided with a preferably, though not necessarily, substantially parallelepiped-shaped inner cooking cavity 2*a* for housing the food products to be cooked, which communicates with the outside via a substantially rectangular access opening realized approximately in the center of the front face 2*b* of the casing; a front door 3 which is preferably, though not necessarily, substantially rectangular in shape, and is hinged to the front face 2*b* of the casing to rotate to and from a closing position (see FIG. 1) in which door 3 rests completely against the front face 2*b* to close the access opening realized therein and to substantially airtight seal the cooking cavity 2*a*; an internal heating assembly 4 which is structured for heating and/or maintaining the inside of the inner cooking cavity 2*a* at a given cooking temperature selectable by the user; and a control panel 5 which is preferably, though not necessarily, located on the front face 2*b* of the casing immediately above the access opening realized on the latter, and is structured so as to allow the user to manually control the heating assembly 4.

More specifically, in the example shown, boxlike casing 2 is substantially parallelepiped in shape and is preferably, though not necessarily, made of metal material conveniently coated with a covering of thermal isolating material; whereas internal heating assembly 4 comprises a resistor 6 which is preferably, though not necessarily, located on the bottom of the inner cooking cavity 2*a*, and an electronic central control unit 7 which powers resistor 6 so as to heat and/or maintain the inside of the inner cooking cavity 2*a* at a cooking temperature selectable by the user via control panel 5.

Front door 3, instead, has preferably, though not necessarily, a double-glazed type structure to provide the necessary thermal isolation, and is hinged onto the front face 2*b* of the casing next to its lower horizontal edge, so as to be able to rotate about a substantially horizontal reference axis A between a raised closing position (see FIG. 1), in which the perimeter of the front door 3 completely abuts against the surface of front face 2*b* to completely close the access opening and seal the inner cooking cavity 2*a*; and a lowered opening position in which front door 3 extends substantially horizontally immediately below the access opening on front face 2*b*, so as to cantileverly jut out from front face 2*b* while remaining substantially parallel to the ground, and completely free the access opening on front face 2*b*.

Figure 4:
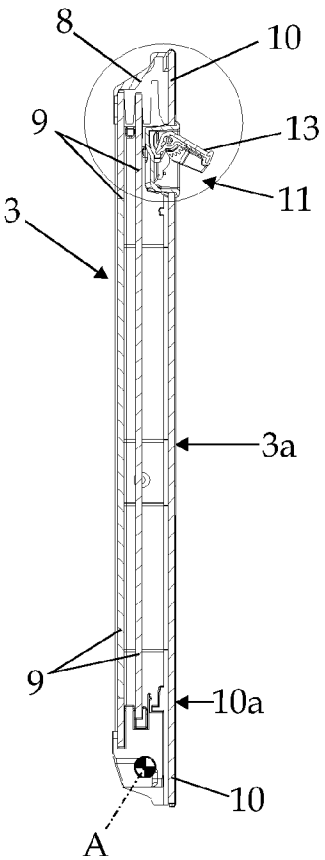
FIG. 4 is a section view of the front door of the household oven according to section line IV-IV of FIG. 3.
Figure 3:
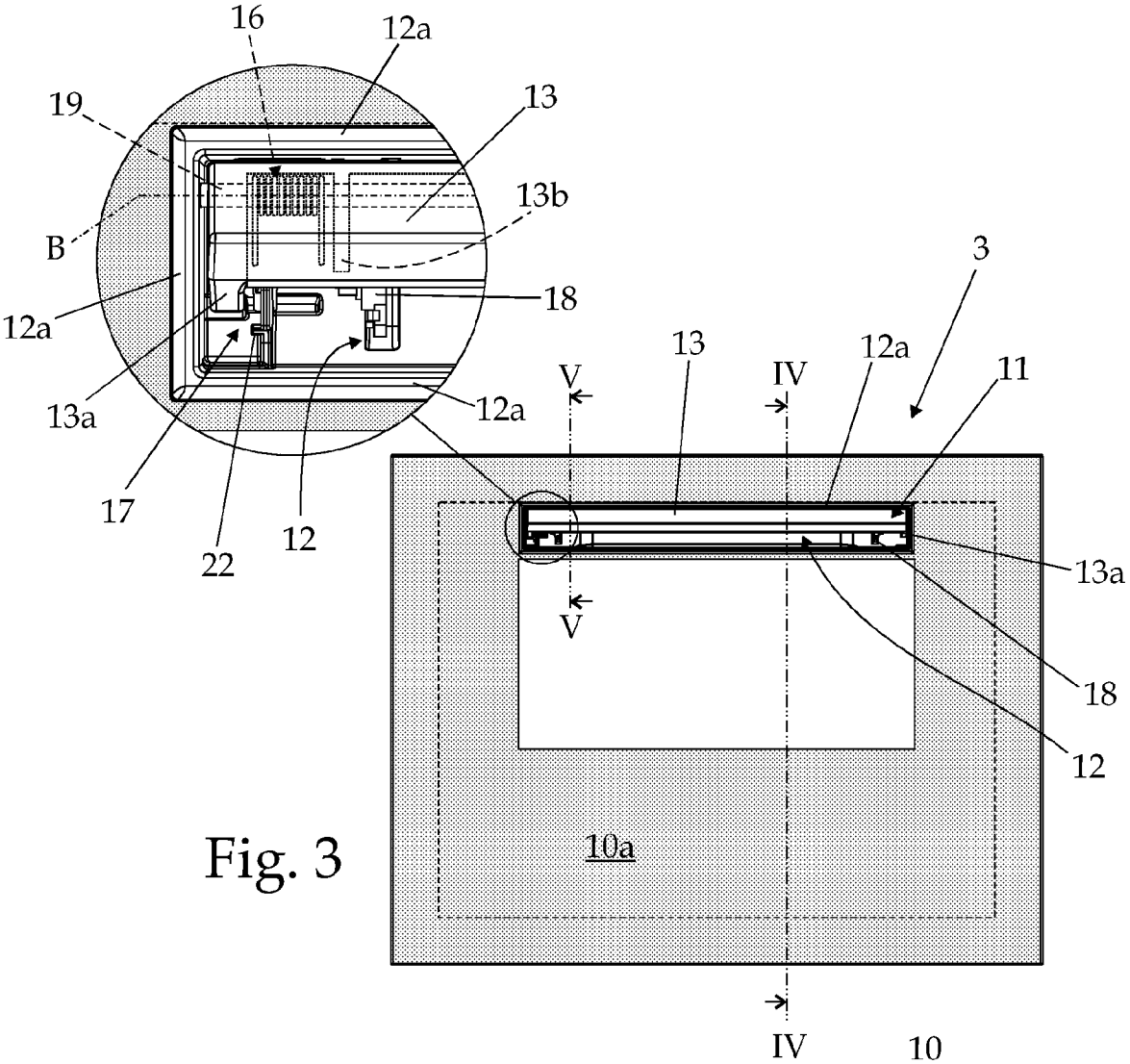
FIG. 3 is a front view of the front door of the FIG. 1 household oven, with parts removed for clarity.

More specifically, with reference to FIGS. 3 and 4, front door 3 comprises a rigid and substantially rectangular or U-shaped perimetrical frame 8 which is structured for being pivotally jointed to the front face 2*b* of the casing to freely rotate about axis A next the lower horizontal edge of the frame; two substantially rectangular inner door-panels 9 which are rigidly fitted into perimetrical frame 8 parallel to and spaced from one another, so as to form a double-glazed thermal isolating structure, and are preferably, though not necessarily, made of safety annealed glass or other transparent material; and a substantially rectangular outer door-panel 10 which is rigidly fixed—for example glued—onto the outer face of perimetrical frame 8 so as to be parallel to and spaced from the inner door-panels 9, and is structured and dimensioned so as to completely cover and hide the perimetrical frame 8 when front door 3 is placed in the raised closing position.

In other words, outer door-panel 10 is preferably, though not necessarily, at least partly opaque so as to completely hide the perimetrical frame 8 which is attached to.

In the example shown, in particular, alike inner door-panels 9, outer door-panel 10 preferably, though not necessarily, consists of a sheet of safety annealed glass or other transparent material, but the front or rear face of the sheet is additionally covered, coated or subjected to a surface treatment which makes the whole surface of the sheet completely opaque except for a small and preferably, though not necessarily, rectangular-shaped area which is located approximately in the center of the outer door-panel 10.

More specifically, in the example shown, the front face 10*a* of the annealed glass sheet 10 is additionally subjected to a satinizing surface treatment which makes completely opaque the whole surface of the front face of the glass sheet except for a small and rectangular area located approximately in the center of the outer door-panel 10. This transparent area in the center of the outer door-panel 10 allows the user to watch the food products housed into the inner cooking cavity 2*a* during the cooking process.

With reference to FIGS. 1 to 6, differently from today's household ovens, household oven 1 is further provided with a push-push handle 11 which is completely recessed into a seat 11*a* realized in the outer face 3*a* of front door 3, i.e. into the outer door-panel 10 of door 3, and is structured for alternatively assuming a stable withdrawn position (see FIGS. 1 and 2) in which the push-push handle 11 remains motionless completely housed into front door 3 and forms part of the outer face 3*a* of front door 3, and a stable extracted position (see FIGS. 3, 4, 5 and 6) in which the push-push handle 11 motionless partly protrudes out of the outer face 3*a* of front door 3, so as to be seizable by the user that wants to move the front door 3 from the raised closing position to the lowered opening position.

More specifically, in the example shown push-push handle 11 is preferably, though not necessarily, rectangular in shape; is oriented preferably, though not necessarily, horizontally on the outer face 3*a* of door 3, so that the two opposite long lateral edges of the handle are substantially parallel to the door rotation axis A; and is irremovably fitted into a complementary seat 11*a*, namely a through opening 11*a*, which is realized on the outer door-panel 10 preferably, though not necessarily, immediately above the transparent area of the latter.

Figure 6:
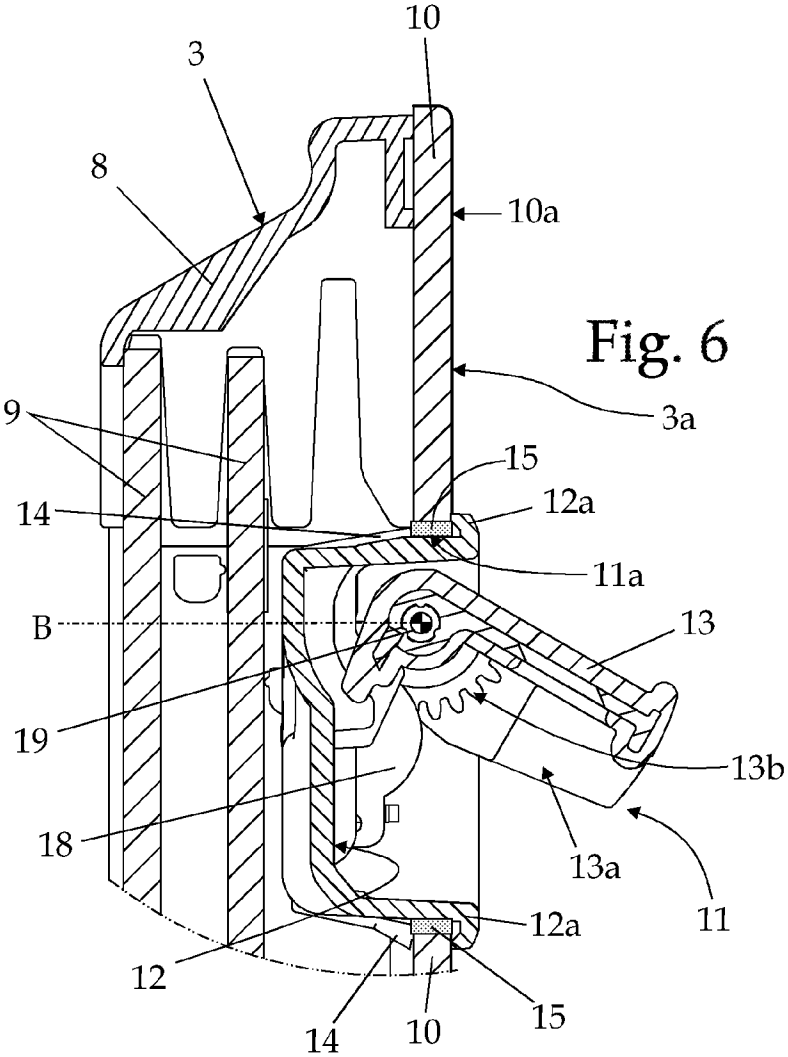
Figure 5:
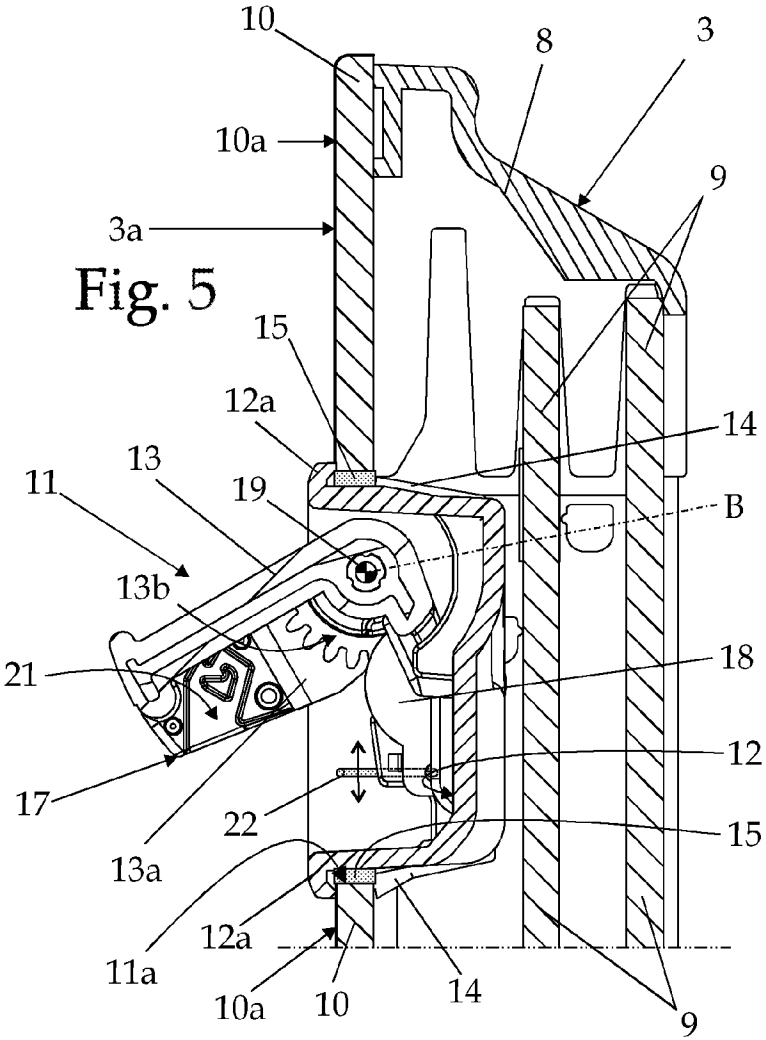
FIG. 5 is a section view of the front door of the household oven according to section line V-V of FIG. 3.

In particular, with reference to FIGS. 4, 5 and 6, the push-push handle 11 comprises a substantially rectangular, basin-shaped shell or vessel 12 which is completely fitted/recessed into opening 11*a* so that its rim 12*a* is substantially coplanar to the front face 10*a* of the outer door-panel 10, i.e. substantially coplanar to the outer face 3*a* of front door 3; and a substantially rectangular-shaped flat lid 13 which substantially copies the perimeter of rim 12*a*, is located within vessel 12 substantially coplanar to the rim 12*a* of vessel 12, and is pivotally jointed to the basin-shaped shell or vessel 12 so as to rotate about a reference axis B, between a closed position (see FIGS. 1 and 2) in which the lid 13 is substantially coplanar to the rim 12*a* of vessel 12 and closes the basin-shaped shell or vessel 12, and an opened position (see FIGS. 3 to 6) in which the lid 13 is rotated/tilted, with respect to the reference laying plane of the rim 12*a*, of a given angle greater than 10° and preferably, though non necessarily, ranging between 45° and 75°, so as to partly protrude out of the basin-shaped shell or vessel 12.

More specifically, with reference to FIGS. 5 and 6, reference axis B is located behind lid 13, between the reference laying plane of the rim 12*a* and the bottom of vessel 12, and extends locally substantially parallel to the two opposite long lateral sidewalls of vessel 12, close to the upper lateral edge of the lid 13; and the flat lid 13 is provided with two side winglets 13*a* which project from the two opposite short lateral edges of the lid, faced and parallel one another, and extend towards the bottom of vessel 12 while remaining locally perpendicular to the reference laying plane of flat lid 13 and locally parallel to the short lateral sidewalls of vessel 12. The two side winglets 13*a* of flat lid 13 are therefore locally perpendicular to rotation axis B, and are pivotally jointed to the short lateral sidewalls of vessel 12, close to rim 12*a*, so as to allow flat lid 13 to freely swing about axis B.

With reference to FIGS. 5 and 6, in turn, the basin-shaped shell or vessel 12 is preferably, though not necessarily, provided with a snap-on locking mechanism for irremovably anchoring the vessel 12 into the seat 11*a* on the outer face 3*a* of door 3. In the example shown, this snap-on locking mechanism consists in a number of flexible flaps and/or tongues 14 which outwardly project from the vessel 12 and hook onto the rear face of outer door-panel 10.

Preferably, though non necessarily, the basin-shaped shell or vessel 12 is irremovably fixed to door-panel 10 also via two longitudinal strips 15 of a preferably, though not necessarily, silicon-based glue, which are positioned on the two opposite long lateral sidewalls of vessel 12, immediately behind the rim 12*a* of vessel 12.

In the example shown, in particular, basin-shaped vessel 12 and flat lid 13 are preferably, though not necessarily, made of plastic material, and the outer surface of the two opposite long lateral sidewalls of vessel 12 is plasma polished beneath the strip 15 of glue, so to increase adhesion of the two longitudinal strips 15 of silicon-based glue on the body of vessel 12.

With reference to FIGS. 3, 5 and 6, the push-push handle 11 also comprises an elastic assembly 16 which is housed into the basin-shaped shell or vessel 12, behind flat lid 13, and is structured for elastically pushing and keeping the flat lid 13 in the opened position; an automatic locking device 17 which is housed into the basin-shaped shell or vessel 12, behind flat lid 13, and is structured for selectively blocking the flat lid 13 in the closed position; and a rotation damping assembly 18 which, alike elastic member 16 and automatic locking device 17, is housed into the basin-shaped shell or vessel 12 behind flat lid 13, and is structured for slowing down the rotating speed of flat lid 13 about axis B so to have a soft stop of the flat lid 13 in the opened position.

In the example shown, in particular, the elastic assembly 16 preferably, though not necessarily, consists in a couple of torsion springs 16 which are fitted on the two axial ends of the transversal pin 19 which rotatably connects flat lid 13 to the short lateral sidewalls of vessel 12, close to the two side winglets 13*a* of the lid; whereas rotation damping assembly 18 preferably, though not necessarily, consists in a couple of rotation dampers 18 which are located beside the torsion springs 16, and are structured to progressively thwart the elastic force of elastic member 16 acting on the flat lid 13 to push and keep the lid into the opened position, so as to progressively slow down the rotation speed of the flat lid 13 as the lid 13 moves towards the opened position.

Rotation dampers 18 are commonly known parts in the industry (the structure of a progressive rotation damper, for example, is disclosed in U.S. Pat. No. 4,893,522) and won't be described in further details, apart from the fact that, in the example shown, each rotation damper 18 is firmly fixed on the bottom of vessel 12, and is mechanically connected to flat lid 13 via a respective toothed circle sector 13*b* which projects from the body of flat lid 13 so as to be locally faced and parallel to a respective side winglet 13*a* of the same lid, and meshes with the revolving shaft of the rotation damper 18.

With reference to FIG. 3, in the example shown, each torsion spring 16 is fitted on transversal pin 19 in the space between a respective side winglet 13*a* of flat lid 13 and the corresponding adjacent toothed circle sector 13*b*.

With reference to FIGS. 3 and 5, automatic locking device 17 instead comprises a cam-profiled groove 21 realized on one of the two side winglets 13*a* of the flat lid 13; and a L-shaped swinging pin 22 which protrudes from the bottom of vessel 12 in a direction substantially perpendicular to the reference laying plane of the rim 12*a* of vessel 12, is structured for swaying on a plane locally substantially perpendicular to rotation axis B, and finally has the distal end engaged in sliding manner into the cam-profiled groove 21.

The cam-profiled groove 21 is shaped so as to alternatively move/sway the swinging pin 22 between a locking position in which the distal end of swinging pin 22 firmly locks the side winglet 13*a* of the lid so as to stably restrain the flat lid 13 in the closed position, and an unlocking position in which the distal end of swinging pin 22 does not engage the side winglet 13*a* of the lid and allows the elastic assembly 16 to push and keep the flat lid 13 in the opened position until the user manually pushes the flat lid 13 back in the closed position.

General operation of the electric built-in household oven 1 is clearly inferable from the above description, with no further explanation required.

As regards the operation of the recessed push-push handle 11, to open the flat lid 13 of handle 11 the user is requested to push gently on the lid 13 so as to cause a small inward rotation of the lid about axis B, which causes the angular displacement of the swinging pin 22 from the locking position to the unlocking position. A few digress suffices.

When placed in the unlocking position, the swinging pin 22 ceases to rigidly connect the flat lid 13 to the bottom of vessel 12 so to impair the rotation of lid 13 about axis B in the opened position, and allows the elastic assembly 16 to immediately push and keeping the flat lid 13 in the opened position.

Rotation speed of flat lid 13 from the closed position into the opened position is progressively reduced by the rotation damping assembly 18, so as to obtain a soft stop of the flat lid 13 in the opened position.

When located in the opened position, the flat lid 13 is easy seizable by the user's hand for manually move the front door 3 from the raised position to the lowered position.

To move back and block the flat lid 13 in the closed position, instead, the user is requested to manually and gently push the flat lid 13 back in the closed position and then slowly push the flat lid 13 inwards for a few degrees, so as to cause the angular displacement of the swinging pin 22 from the unlocking position to the locking position.

When placed in the locking position, the swinging pin 22 is again able to rigidly connect the flat lid 13 to the bottom of vessel 12 so to impair the rotation of lid 13 about axis B from the closed position to the opened position.

The advantages connected to the presence of the recessed push-push handle 11 on front door 3 are large in number. First of all, when set in the withdrawn position, the push-push handle 11 is completely recessed into the front door 3, and does not hamper a person standing and/or moving very close to the outer face 3*a* of front door 3.

Additionally, push-push handle 11 is much more user friendly than a push-pull handle because push-push handle 11, contrary to traditional push-pull handles, remains indefinitely in the extracted position alike the traditional permanently-protruding large horizontal handles used in today's electric household ovens.

Finally, the aesthetic appearance of the front door 3 pleases the requirements of several interior designers which want the front door of the household oven to be aesthetically and structurally more similar the front panels of the surrounding kitchen furniture, so as to create a pleasing continuity in the kitchen interior design.

Clearly, changes may be made to the electric household oven 1 as described herein without, however, departing from the scope of the present invention.

Figure 7:
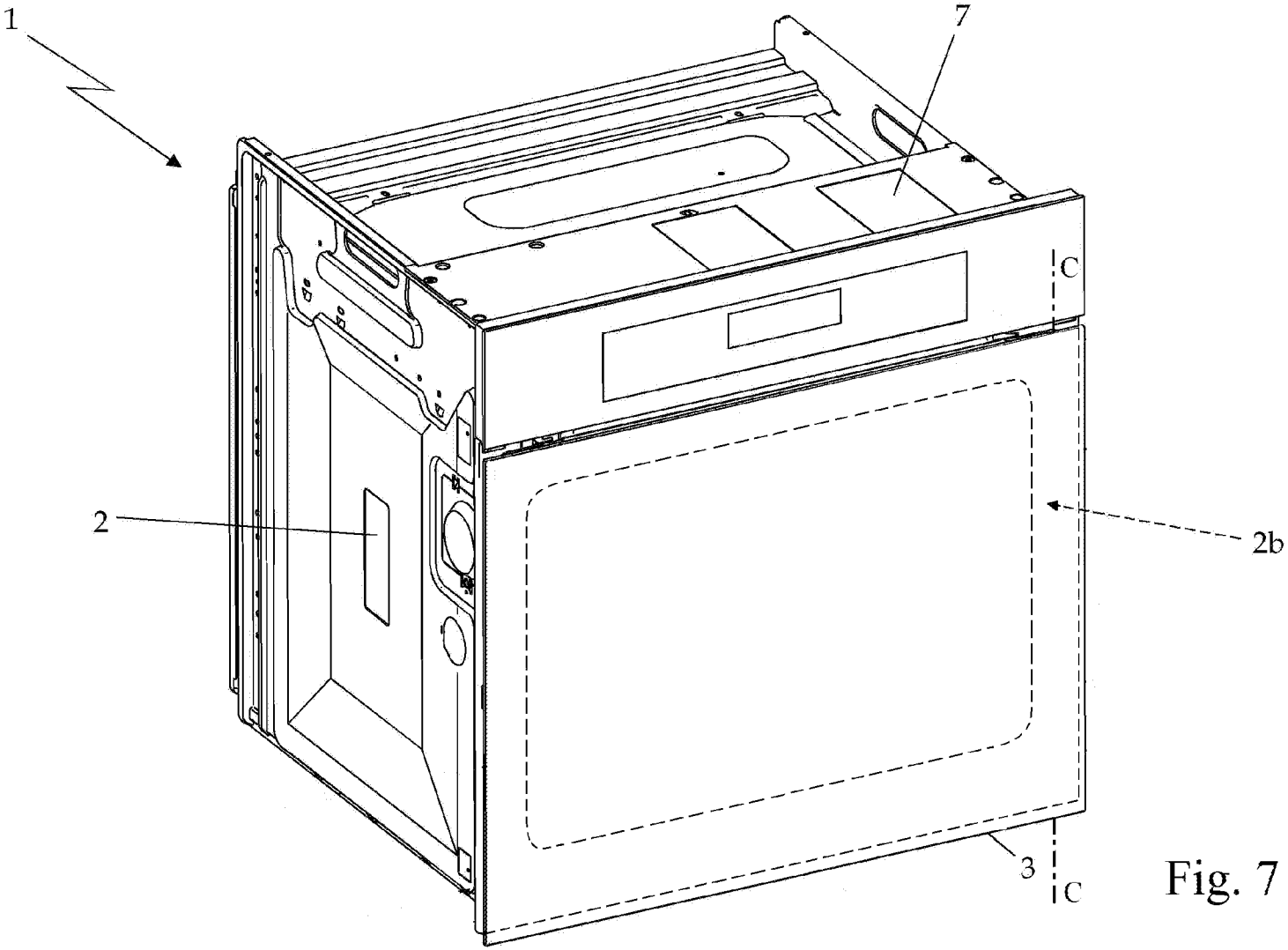
FIG. 7 is a perspective view of the household oven according to an alternative embodiment.

For example, as shown in FIG. 7, in a different embodiment, front door 3 may be hinged onto the front face 2*b* of the casing next to its right or left vertical edge, so as to be able to rotate about a substantially vertical reference axis C between a closing position in which the perimeter of the front door 3 completely abuts against the surface of front face 2*b* to completely close the access opening and seal the inner cooking cavity 2*a*; and an opening position in which front door 3 extends vertically beside the access opening on front face 2*b*, so as to completely free the access opening on front face 2*b*. In this case, push-push handle 11 may be oriented vertically on outer face 3*a* of front door 3.

In addition to the above, in a further different embodiment heating assembly 4 may comprise a traditional gas burner located onto the bottom of the inner cooking cavity 2*a*, and/or boxlike casing 2 may be structured for resting on ground stand-alone.

The invention claimed is:

1. A household oven (1) comprising an outer boxlike casing (2) which is internally provided with a inner cooking cavity (2*a*) for housing the food products to be cooked and that communicates with the outside via an access opening realized on the front face (2*b*) of the casing, a front door (3) which is hinged to the front face (2*b*) of the casing to rotate to and from a closing position in which the front door (3) rests against the front face (2*b*) of the casing to close the access opening realized therein, and an internal heating assembly (4) which is structured for heating and/or maintaining the inside of the inner cooking cavity (2*a*) at a given cooking temperature;

wherein a push-push handle (11) which is positioned in a seat (11*a*) realized in the outer face (3*a*) of the front door (3), and is structured for alternatively assuming a stable withdrawn position in which the push-push handle (11) remains motionless completely housed into the front door (3) and forms part of the outer face (3*a*) of the front door (3), and a stable extracted position in which the push-push handle (11) remains motionless partly protruding out of the outer face (3*a*) of the front door (3) so as to be seizable by the user, and wherein the push-push handle (11) comprises a substantially basin-shaped vessel (12) which is recessed into the seat (11*a*) on the front door (3) so that a rim (12*a*) of the vessel (12) covers and abuts a portion of the outer face (3*a*) of the front door (3), and wherein the push-push handle (11) comprises a substantially flat lid (13) having a cam-profiled groove (21) that engages a swinging pin (22) in the stable withdrawn position to lock the push-push handle (11) in the stable withdrawn position.

2. The household oven according to claim 1, wherein the push-push handle (11) comprises a substantially flat lid (13) which is located within the vessel (12) substantially coplanar to the rim (12*a*) of the vessel, and is pivotally jointed to the basin-shaped vessel (12) so as to rotate about a first reference axis (B) between a closed position in which the flat lid (13) is substantially coplanar to the vessel rim (12*a*) and closes the basin-shaped vessel (12), and an opened position in which the lid (13) is rotated/tilted of an angle greater than 10° with respect to a reference laying plane of the rim (12*a*), so as to partly protrude out of the basin-shaped vessel (12).

3. The household oven according to claim 2, wherein the said first reference axis (B) is located behind the flat lid (13), between the reference laying plane of the rim (12*a*) and the bottom of vessel (12).

4. The household oven according to claim 2, wherein the push-push handle (11) also comprises rotation damping means (18) which are housed into the basin-shaped vessel (12), behind the flat lid (13), and are structured for slowing down the rotating speed of the flat lid (13) about the first reference axis (B).

5. The household oven according to claim 4, wherein said rotation damping means (18) are structured to progressively thwart the elastic force of the elastic assembly (16) acting on the flat lid (13) for pushing and keeping said lid into the opened position, so as to progressively slow down the rotation speed of the flat lid (13) as the lid moves towards the opened position.

6. The household oven according to claim 2, wherein the flat lid (13) substantially copies the perimeter of the rim (12*a*) of the basin-shaped vessel (12).

7. The household oven according to claim 2, wherein both the basin-shaped vessel (12) and the flat lid (13) are substantially rectangular in shape.

8. The household oven according to claim 1, wherein the push-push handle (11) also comprises elastic means (16) which are housed into the basin-shaped vessel (12) behind the flat lid (13), and are structured for elastically pushing and keeping the flat lid (13) in the opened position.

9. The household oven according to claim 1, wherein the push-push handle (11) also comprises automatic locking means (17) which are housed into the basin-shaped vessel (12), behind the flat lid (13), and are structured for selectively blocking the flat lid (13) in the closed position.

10. The household oven according to claim 1, wherein the basin-shaped vessel (12) is provided with a snap-on locking mechanism (14) for irremovably anchoring the vessel (12) into the seat (11*a*) on the outer face (3*a*) of the front door (3).

11. The household oven according to claim 1, wherein the basin-shaped vessel (12) is irremovably anchored to the front door (3) via at least one longitudinal strip (15) of glue which is positioned on a lateral sidewall of the vessel (12), immediately behind the rim (12*a*) of the vessel.

12. The household oven according to claim 11, wherein the surface of the said lateral sidewall of the vessel (12) is plasma polished beneath said strip (15) of glue.

13. The household oven according to claim 1, wherein the front door (3) has a double-glazed type structure.

14. The household oven according to claim 1, wherein the front door (3) is hinged onto the front face (2*b*) of the casing (2) next to one of its lateral edge, so as to be able to rotate about a substantially horizontal or vertical second reference axis, between a closing position in which the perimeter of the front door (3) completely abuts against the surface of the front face (2*b*) to close the access opening and seal the inner cooking cavity (2*a*); and an opening position in which the front door (3) extends substantially horizontally or vertically immediately below or beside the access opening on the front face (2*b*), so as to completely free the access opening on said front face (2*b*).

15. A household oven (1) comprising an outer boxlike casing (2) which is internally provided with an inner cooking cavity (2*a*) for housing the food products to be cooked and that communicates with the outside via an access opening realized on the front face (2*b*) of the casing, a front door (3) which is hinged to the front face (2*b*) of the casing to rotate to and from a closing position in which the front door (3) rests against the front face (2*b*) of the casing to close the access opening realized therein, and an internal heating assembly (4) which is structured for heating and/or maintaining the inside of the inner cooking cavity (2*a*) at a given cooking temperature;

wherein a push-push handle (11) which is positioned in a seat (11*a*) realized in the outer face (3*a*) of the front door (3), and is structured for alternatively assuming a stable withdrawn position in which the push-push handle (11) remains motionless completely housed into the front door (3) and forms part of the outer face (3*a*) of the front door (3), and a stable extracted position in which the push-push handle (11) remains motionless partly protruding out of the outer face (3*a*) of the front door (3) so as to be seizable by the user, wherein the push-push handle (11) comprises a substantially basin-shaped vessel (12) which is recessed into the seat (11*a*) on the front door (3) so that a rim (12*a*) of the vessel (12) is substantially coplanar to the outer face (3*a*) of the front door (3), and wherein the basin-shaped vessel (12) is provided with a snap-on locking mechanism (14) for irremovably anchoring the vessel (12) into the seat (11*a*) on the outer face (3*a*) of the front door (3).

16. A household oven (1) comprising an outer boxlike casing (2) which is internally provided with an inner cooking cavity (2*a*) for housing the food products to be cooked and that communicates with the outside via an access opening realized on the front face (2*b*) of the casing, a front door (3) which is hinged to the front face (2*b*) of the casing to rotate to and from a closing position in which the front door (3) rests against the front face (2*b*) of the casing to close the access opening realized therein, and an internal heating assembly (4) which is structured for heating and/or maintaining the inside of the inner cooking cavity (2*a*) at a given cooking temperature;

wherein a push-push handle (11) which is positioned in a seat (11*a*) realized in the outer face (3*a*) of the front door (3), and is structured for alternatively assuming a stable withdrawn position in which the push-push handle (11) remains motionless completely housed into the front door (3) and forms part of the outer face (3*a*) of the front door (3), and a stable extracted position in which the push-push handle (11) remains motionless partly protruding out of the outer face (3*a*) of the front door (3) so as to be seizable by the user, wherein the push-push handle (11) comprises a substantially basin-shaped vessel (12) which is recessed into the seat (11*a*) on the front door (3) so that a rim (12*a*) of the vessel (12) is substantially coplanar to the outer face (3*a*) of the front door (3), and wherein the basin-shaped vessel (12) is irremovably anchored to the front door (3) via at least one longitudinal strip (15) of glue which is positioned on a lateral sidewall of the vessel (12), immediately behind the rim (12*a*) of the vessel.

* * * * *

UNITED STATES PATENT AND TRADEMARK OFFICE

CERTIFICATE OF CORRECTION

PATENT NO. : 9,291,353 B2
APPLICATION NO. : 13/576486
DATED : March 22, 2016
INVENTOR(S) : Marco Saporetti and Cris Tridello It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 695 days.

Signed and Sealed this
Nineteenth Day of July, 2016

Michelle K. Lee

Michelle K. Lee
*Director of the United States Patent and Trademark Office*